United States Patent [19]

Kaminski

[11] 3,957,333

[45] May 18, 1976

[54] UNIVERSAL CONTROL SYSTEM INTERFACE

[75] Inventor: David C. Kaminski, Sylvania, Ohio

[73] Assignee: Dana Corporation, Toledo, Ohio

[22] Filed: Nov. 1, 1974

[21] Appl. No.: 520,083

[52] U.S. Cl. ..... 339/32 R; 317/7; 339/185 R

[51] Int. Cl.[2] ..... H01R 27/00

[58] Field of Search ..... 339/19, 222, 31, 32, 339/33, 10, 154, 155, 185; 307/9, 10; 317/7, 8; 325/312

[56] References Cited

UNITED STATES PATENTS

| | | | |
|---|---|---|---|
| 502,300 | 8/1893 | Kells, Jr. | 317/7 X |
| 2,964,620 | 12/1960 | Schulenberg | 339/32 M |
| 3,307,051 | 2/1967 | Parsons | 339/31 R |
| 3,353,139 | 11/1967 | Ribbelink | 339/18 R |
| 3,581,480 | 6/1971 | O'Connor et al. | 339/32 M |

*Primary Examiner*—Roy Lake
*Assistant Examiner*—Neil Abrams
*Attorney, Agent, or Firm*—Robert E. Pollock

[57] ABSTRACT

Disclosed is an interfacing connector to allow use of a control system with an external signal source which can be either a switched "hot" or a switched ground. Both such signal sources are found in certain applications, particularly in motor vehicles. The connector consists of a first plug associated with the control system and a second plug associated with the switched signal lead. The first plug includes two sets of three terminals per set, one for use with a switched "hot" signal and one for use with a switched ground signal. The second plug includes three terminals adapted for connection to either of the two sets of terminals. A relay or other control element is connected to the first plug and associated with the control circuit. Signal input and interconnection means are provided whereby the second plug is operatively connected with the control element upon insertion in the correct one of the sets of terminals on said first plug. The device will not give false signals if an incorrect connection is made. In a preferred mode the plugs are so sized and configured as to prevent the most common types of incorrect connection.

4 Claims, 2 Drawing Figures

20

11
SIGNAL
11a
11b
11c
13
15
16
12a
12b
12c
14
10
12
32
31c
30
31a
31b
SWITCHED SIGNAL
POLARITY SENSITIVE ELEMENT
40
11
13
11a
11b
SIGNAL
11d
11c
17
18
12a
12b
12c
12d
14
10
12
31a
31b
31c
31d
32
30

SWITCHED SIGNAL

UNIVERSAL CONTROL SYSTEM INTERFACE

BACKGROUND OF THE INVENTION

In many types of electrical systems and notably in motor vehicles, there is little standardization of signals. A prime example of the lack of standardization is the fact that many motor vehicles use an external (to the item being controlled) signal source such as switches in the ground circuit while others use switches in the "hot" (+12V) circuit. In some cases, for convenience, a single vehicle may have both switched hot and ground signals. Without limiting the generality of the present invention, all references hereinafter will be to a motor vehicle system, it being understood that the invention as claimed will find use in many other applications.

It is often desirable to have a universal control or other electrical system which can be used in motor vehicles regardless of the nature of the signals available therein. Such universality has not been found in the known prior art and various compromises have therefore had to be made. Additionally at least certain of the prior art devices are not fail safe in the event of an incorrect connection from an external signal.

It is therefore an object of the invention to provide an interface means to allow an electronic control system or the like to be readily used with external signals of differing types, particularly with "hot" and "ground" signals.

It is another object to provide such a means which is fail safe in the event of an incorrect connection.

It is a further object of the invention to provide such an interface in an extremely simple way.

SUMMARY OF THE INVENTION

The above and other objects are provided with a two plug connector system including interconnection means associated therewith. A first plug is associated with the control circuit and includes at least two sets of terminals with at least three terminals per set. One set of terminals is used for a switched hot input and the other is used for a switched ground input.

In use, an element of the control system is connected to a pair of terminals on each set thereof on the first plug. A source of hot signal is connected to the third terminal of the set used for connection with a switched ground signal. The third terminal of the other set is connected to ground.

A second plug is associated with the external signal and includes three terminals which are adapted to mate with either of the sets of terminals on the first plug. The second plug includes an interconnecting means between a pair of the terminals thereof.

In a preferred embodiment, the plugs are polarized so as to assure the correct orientation between the terminals of the second plug and the terminals of either set on the first plug. Additionally, the size and geometry of the first and second plugs are preferably such that two plugs such as the second cannot be corrected simultaneously with the first plug.

BRIEF DESCRIPTION OF THE DRAWINGS

While the specification concludes with claims which particularly point out and distinctly claim the present invention it is believed that the same will be better understood with reference to the following description taken in conjunction with the accompanying drawings in which:

DESCRIPTION OF THE PREFERRED EMBODIMENT

Figures 1, 2:
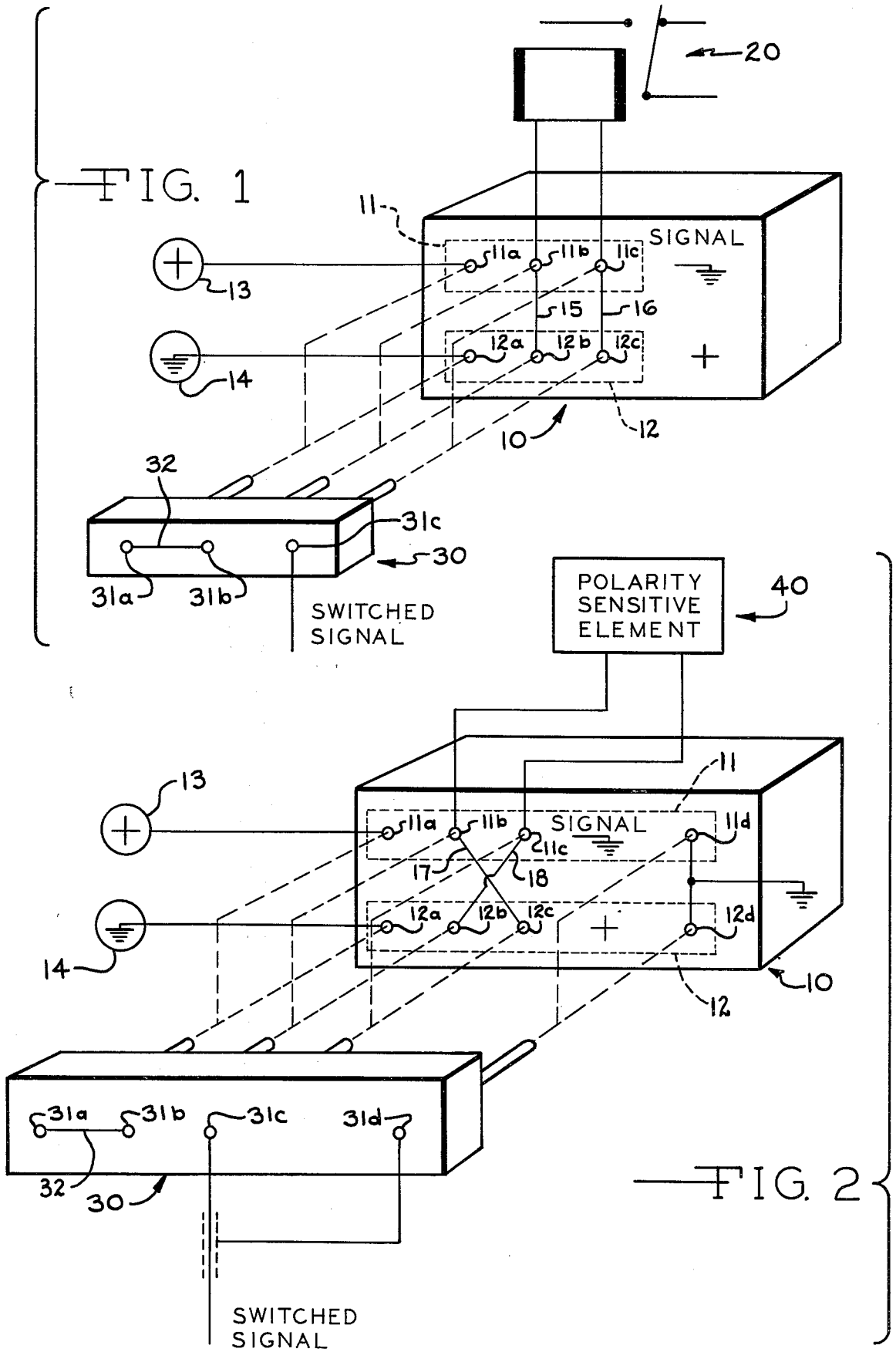
FIG. 1 is a schematic representation of the invention in its simplest form.
FIG. 2 is a schematic representation of the invention in a preferred form showing several features which can be optionally used therewith.

Referring now to the drawings, FIG. 1 illustrates the present invention schematically in its simplest form. The interfacing connector consists essentially of two plugs. The first plug, designated generally by the numeral 10, is associated with the control circuit. Said circuit is shown only in part, specifically by the relay 20 which can be connected into any other elements to initiate, terminate or otherwise modify the control action.

The first plug 10 includes two sets 11 and 12 of at least three (3) terminals 11*a*, *b* and *c* and 12*a*, *b* and *c* per set. The terminals 11*a*, *b* and *c* and 12*a*, *b* and *c* can be of any desired type and preferably are female sockets. The size and spacing of the terminals are not critical to the invention except that each set 11 and 12 must be substantially identical to allow a single mating plug to fit in either set. Certain sizing and spacing is preferred, however, as will be discussed in detail in connection with FIG. 2.

A second plug, designated generally by the numeral 30, is associated with the external switched signal and includes at least three (3) terminals 31*a*, *b* and *c* of such geometry and spacing to mate with terminals of either sets 11 and 12, and normally will be male jacks.

The connections, internal and external, with the plugs 10 and 30, in combination with the geometry of the devices, provide the universality of the present invention. As illustrated, terminal set 11 is associated with a switched ground input; i.e., an input which goes to ground through a controlling switch. Preferably, a suitable designation to such effect is, provided to assure correct connection. Such a designation is shown in the drawings in the form of the word "signal" together with a "+" associated with one set of terminals and a "ground" symbol associated with the other set of terminals. One of the terminals 11*a* of the first set 11 is adapted for connection to a "hot" source 13 indicated by the "+" sign. As will be recognized other non-grounded sources (negative and alternating) are also "hot" in the sense of the present invention. Again, and with reference to motor vehicle systems, a positive 12 volt signal is the common "hot" and further discussion will be limited thereto.

The second terminal set, 12, is associated with the switched "hot" input signal; i.e., an input which goes to a "hot" source through a controlling switch and is so designated by the "+" symbol. The terminal 12*a*, which geometrically corresponds to terminal 11*a* of the first set, is adapted for connection to a ground source 14.

The remaining two terminals of sets 11 and 12 are joined by interconnection means 15 and 16. Interconnection means 15 joins corresponding terminals 11*b* and 12*b* and means 16 joins corresponding terminals 11*c* and 12*c*. An interconnecting means 32 is also provided on the plug 30 and join terminal 31*a*, which connects with either of terminals 11*a* or 12*a*, with one of the other two terminals (31*b* as illustrated) on plug 30. Interconnecting means, or jumper, 32 may conveniently be thought of as a programming means to provide the requisite circuit interconnections when plugs 10 and 30 are connected.

Terminal pairs 11*b*, 12*b* and 11*c*, 12*c* are also adapted for connection to an element of the control circuit, here illustrated as relay 20. The embodiment of FIG. 1 is suited for use only with polarity insensitive devices such as relay 20.

The operation of the embodiment of FIG. 1 is as follows. When a switched ground signal is to be utilized the "switched signal" connected to terminal 31*c* is the switched ground and, the second plug 30 is inserted in the set of terminals so noted; i.e., set 11. Closure of the switch in the external ground signal circuit provides a current path from hot source 13 through jumper 32 and relay 20 to ground thereby energizing the relay. Similarly when the "switched signal" is a switched hot signal, a closure of a switch in the external switched will, upon proper connection of the plugs 10 and 30, allow current to flow from the switched hot signal lead through jumper 16 relay 20, jumper 15 and jumper 32 to ground source 14. It should be noted that should the plug 30 inadvertently be connected improperly that there will be no energization of relay 20 as no voltage differential can be applied thereacross.

While the embodiment of FIG. 1 is satisfactory in some applications, the embodiment of FIG. 2 provides, in a simple manner, a number of additional features which are useful, individually or in combination, and therefore are preferred. Elements common between the embodiment of FIGS. 1 and 2 are similarly numbered in the two figures.

The embodiment of FIG. 2, unlike that of FIG. 1, can interface with a polarity sensitive element, designated generally by the numeral 40, in the control circuit. One example of such an element is an electronic power supply which can be used to power the remainder of the control circuit. Many examples of such power supplies and other polarity sensitive devices are known in the art and therefore not described in more detail hereinafter.

The ability to accommodate polarity sensitive devices results from providing interconnecting means in the form of jumpers 17 and 18 between terminal 11*b* and 12*c* and 12*b* and 11*c* respectively; i.e., between opposite ones of the pairs of the terminals of the first and second sets. As will be observed, when the second plug 30 is associated with a switched ground and therefore connected to the upper set 11 of terminals, terminal 11*b* and the positive side of the element 40 is connected to positive source 13 through jumper 32. The switched ground is inserted in terminal 11*c* and thereby connected to the ground connection of the element 40. With a switched hot signal the plug 30 is inserted in the lower set 12 of terminals on the first plug. When so connected, the switched hot is connected to the positive side element 40 via jumper 17. The ground source 14 is connected to the ground side of the element 40 through jumpers 32 and 18.

Again, as with the configuration of FIG. 1 it will be seen that an incorrect connection cannot lead to inadvertent imposition of a voltage across the element 40.

The embodiment of FIG. 2 also includes provision in the form of terminals 11*d* and 12*d* on the first plug and 31*d* on the second plug to ground the shield of a shielded lead. The terminals 11*d* and 12*d* are connected to ground for this purpose. Other such terminals can be provided for any desired additional connections.

As will be noted, terminals 11*d*, 12*d* and 31*d* are spaced from the adjacent terminals by a different amount from the spacing between the other terminals. Such an arrangement provides a keying effect and prevents incorrect connection between the second plug and the terminals within the sets thereof on the first plug. Many other keying means, e.g. terminals of different sizes, shapes and orientations are well known in the art and suitable for use herewith.

A final feature of the embodiment of FIG. 2 is the provision of means to avoid inadvertent energization of the element 40, by the connection of a plug 30 to each of the sets 11, 12 of terminals on the first plug. In most applications, this result is most readily, and therefore preferably, provided by placing the sets 11, 12 of terminals close together in relation to the size of the second plug. By such an arrangement there is insufficient room to plug two plugs 30 in at the same time to the two sets of terminals 11, 12.

Many other variations will occur to those skilled in the art with reference to the foregoing description of the preferred embodiments.

What is claimed is:

1. In a control system having an element thereof adapted for energization by an external signal providing selective communication with a hot source or a ground source, an interface means comprising a first and second plugs said first plug including two sets of corresponding terminals with three terminals per set a first terminal of said first set connected to a hot source and the corresponding terminal of said second set connected to a ground source, a second terminal on said first set connected to said element and to a second terminal of said second set, the third terminal of said first set connected to said element and to a third terminal of said second set, said second plug including three terminals adapted for selective connection to either said first or said second set of terminals on said first plug a jumper connecting a first terminal of said second plug corresponding to the first terminals on said first plug with a second terminal on said second plug, and said external signal being connected to the third terminal of said second plug whereby said circuit is operable, by the proper connection of said first and second plugs whether said external signal provides selective communication with either a ground source or a hot source.

2. The system of claim 1 wherein said first and second plugs are polarized whereby said second plug can be connected in only one way with each of the sets of terminals on said first plug.

3. The system of claim 1 wherein said first and second plugs are so sized and arranged that when said second plug is engaging said first set of terminals on said first plug a third plug identical to said second plug cannot be engaged with said second set of terminals on said first plug.

4. The system of claim 3 wherein said first and second plugs are polarized whereby said second plug can be connected in only one way with each of the sets of terminals on said first plug.

* * * * *